United States Patent [19]

Braley

[11] Patent Number: 4,940,240

[45] Date of Patent: Jul. 10, 1990

[54] GAME TO PROMOTE ARITHMETIC SKILLS

[76] Inventor: Joseph M. Braley, P.O. Box 488, Moab, Utah 84532

[21] Appl. No.: 350,454

[22] Filed: May 11, 1989

[51] Int. Cl.[5] ..... A63F 3/02; A63F 3/00

[52] U.S. Cl. ..... 273/260; 273/272; 273/291

[58] Field of Search ..... 273/260, 261, 272, 291, 273/243

[56] References Cited

U.S. PATENT DOCUMENTS

| | | | |
|---|---|---|---|
| 191,169 | 5/1877 | Nutting | 273/242 |
| 400,237 | 3/1889 | Martane | 273/243 |
| 571,464 | 11/1896 | Truex | 273/258 |
| 574,192 | 12/1896 | Climenson | 273/242 |
| 604,401 | 5/1898 | Lang | 273/242 |
| 875,230 | 12/1907 | Youngman | 273/242 |
| 1,099,563 | 6/1914 | Meyers | 273/243 |
| 1,302,305 | 5/1919 | Jentz | 273/243 |
| 2,273,932 | 2/1942 | Caesar | 273/291 |
| 2,320,832 | 6/1943 | Schoenberg et al. | 273/242 |
| 3,455,556 | 7/1969 | Mossman | 273/243 |
| 3,586,333 | 6/1971 | Abney | 273/243 |
| 3,632,111 | 1/1972 | Wicks | 273/258 |
| 3,833,221 | 9/1974 | Van Tol | 273/243 |
| 3,869,124 | 3/1975 | Stein et al. | 273/242 |
| 4,059,276 | 11/1977 | Weniger | 273/243 |
| 4,171,814 | 10/1979 | Tamano | 273/243 |
| 4,194,741 | 3/1979 | Rea | 273/243 |
| 4,211,419 | 7/1980 | Larsen | 273/248 |
| 4,365,812 | 12/1982 | Martini | 273/243 |
| 4,385,764 | 5/1983 | Bhatti | 273/243 |
| 4,391,448 | 7/1983 | Hermann | 273/243 |
| 4,561,658 | 12/1985 | Peterson | 273/243 |
| 4,717,154 | 1/1988 | Miller | 273/243 |

*Primary Examiner*—Benjamin Layno

*Attorney, Agent, or Firm*—Kenton L. Freudenberg; Maxwell C. Freudenberg

[57] ABSTRACT

A game apparatus and related methods of play, comprising a playing board marked with a grid pattern, checker-like pieces to be moved upon the surface of the playing board and using varied markings upon the faces of the pieces and a deck of numbered cards. The methods of play are directed toward the encouragement of the use of arithmetic skills. To begin play, players possess numbers by randomly selecting the number cards, the players then choose an arithmetic function of addition, substraction, multiplication or division which are applied to the randomly selected numbers to determine the direction and quantity of movement of pieces on the playing board and to modify the score of each player.

27 Claims, 2 Drawing Sheets

GAME TO PROMOTE ARITHMETIC SKILLS

BACKGROUND OF THE INVENTION

The present invention is a game for two or more players directed toward the encouragement of the use of mathematical skills by requiring the use of arithmetic functions of addition, subtraction, multiplication and division applied to randomly selected numbers to determine the movement of pieces on a playing board and to accumulate the score of each player.

SUMMARY OF THE INVENTION

The present invention comprises a game known as "DIGITS" for at least two players which uses simple apparatus, adaptable to a variety of methods of play and scoring. The game apparatus comprises a board marked with a grid pattern, pieces which are moved from one distinct position to another over the grid pattern of crossed rows of playing positions along paths which can vary for an individual piece, and a deck of cards which is used to determine the moves of the pieces based on applying simple arithmetic operations to numbers found on the cards. While incorporating an element of chance in the drawing of the cards for play, each player must apply strategy by making the most appropriate choices of arithmetic operations to be applied to numbers taken from the cards. The goal is to achieve the highest possible score while minimizing an opponent's score. A player's score is determined at least in part by the rank and file position of a player's pieces at the end of play with a number value assigned to each piece according to specified rules and may be partially based on opponent's pieces captured. A player uses arithmetic skills to choose among various possible moves of the player's pieces over a board with the goal being to position the player's own pieces so as to maximize his or her own score based upon the rules of the variation being played, while minimizing an opponent's score by, for instance, removing as many of the opponent's pieces from the board as possible.

It is an object of the present invention to provide a simple game apparatus which provides for a wide variety of methods of play and scoring of games using arithmetic functions.

It is another object of the invention to provide a game which utilizes each of the four arithmetic operations so as to encourage the development of arithmetic skills.

It is another object of the present invention to provide a game apparatus and methods of play which incorporate both strategy and chance and in which the game apparatus allows varying the methods of play to emphasize either the skill of the player's or chance as the primary factor in the outcome of the game.

DESCRIPTION OF THE PREFERRED EMBODIMENT

Figure 1:
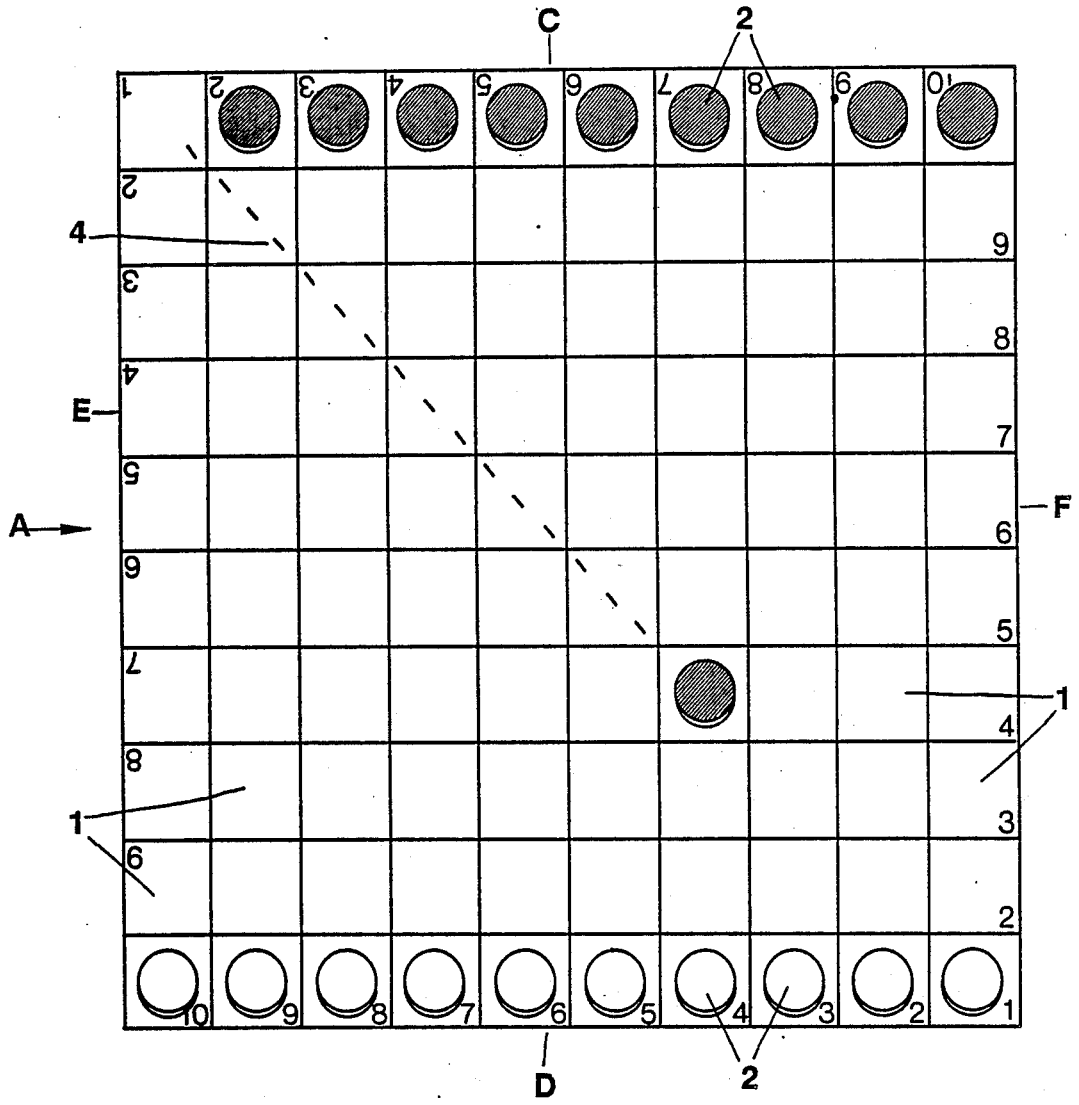
FIG. 1 shows the board of the preferred embodiment with pieces in place for the beginning of play and showing an initial diagonal move of a piece.

In its preferred embodiment the present invention is a board game utilizing a simple apparatus which provides for a variety of methods of play. The game is played by two players on the square flat board A shown in FIG. 1. Board A is marked with a grid pattern similar to an ordinary checkerboard and comprises ten ranks and ten files. There are 100 distinct grid playing positions 1 on such board, each of which can be denoted by its rank and file. As used herein a rank is that row of grid playing positions which are equidistant from a side of the board at which the player is positioned and which is designated by the distance in number of rows from the player's side of the board. A player's first rank is therefore the row of grid positions closest to the player. A file is a row positioned at right angles to any rank. Each rank and each file comprise ten grid positions in the preferred embodiment. As shown in FIG. 1 the files of the board are parallel to edges E and F and are marked with numbers along an edge C or D of the board closest to a player. Ranks of the board are oriented parallel to edges C and D of FIG. 1 and are marked by a vertical column of numbers along edges E or F of the board which are not facing to either player. The marking of ranks and files is such that the markings for each player are properly oriented to be readable by that player.

Figure 3:
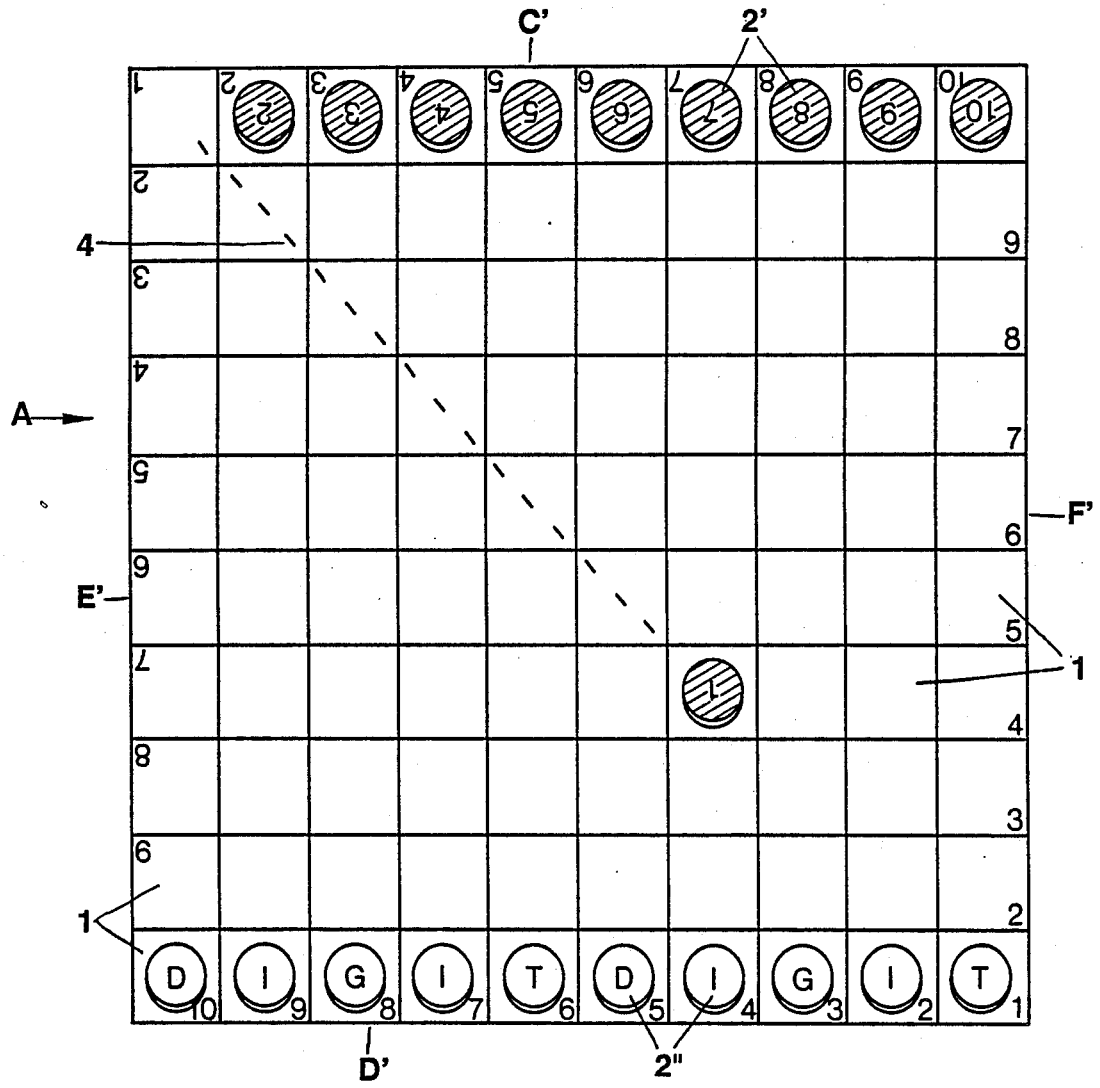
FIG. 3 is similar to FIG. 1, further showing two different markings of pieces for two methods of play.

At the beginning of play each player has an equal number of pieces 2, namely ten (10) which are positioned along the player's side of the board in the player's first rank, each in a distinct file as shown in FIG. 1. Each player's pieces are distinctly colored or otherwise made identifiable as belonging to that particular player. Each piece 2 of FIG. 1 is sized so that when it is positioned on the board it occupies one distinct grid position. The pieces of the preferred embodiment are similar to the pieces used on an ordinary checkerboard. The disk-shaped pieces 2′ shown positioned along edge C′ of the board in FIG. 3 are shown with a numbered marking on the visible face of each piece. Each piece 2′ is marked with a distinct number from 1 to 10 and the pieces are positioned at the beginning of play in such a manner that the number on each piece corresponds to the number of a file, the files being designated consecutively from right to left as viewed by the player. In an alternative embodiment, a face of each piece is marked with a single letter as shown by the pieces 2″ along edge D′. The combination of the letters on each player's pieces form a defined pattern or word. In the embodiment shown by pieces 2″ along edge F′, the individual letter markings of the pieces form two sets of five letters each, each set consisting of the letters of the word "DIGIT". In order to provide for the greatest variety of playing and scoring, each piece may also be marked so that one face bears a number and the opposite face bears a letter.

In the most basic form of play, unmarked pieces 2 as shown along edges C and D of FIG. 1 are used, or the marking of pieces 2′ or 2″ as shown along edges C′ or D′ in FIG. 3 is ignored. Alternatively, numbered or lettered pieces can be positioned randomly at the start of play in discrete positions across the first rank, with the designated marking on the underside and not visible. If the game is played with marked pieces 2′ or 2″, taking into account the visible face of the piece for playing or scoring purposes, each player may readily plan moves so that skill or strategy may become a far more significant factor in the outcome of the game. If the game is played taking into account for scoring a marked face which is on the underside of the piece and not visible, the outcome is more dependent on chance and the laws of probability.

The pieces are played from successively appointed grid file positions in the first rank, from right to left as viewed by the player. A scoresheet or marker is used to keep track of the grid file position designated for each succeeding turn. Players alternate turns, each player playing one piece per turn. Any of a player's pieces which has not reached the player's tenth rank may be chosen to be played a second or subsequent time only if the player has no piece in the appointed grid file position for that turn. A piece which was designated to be moved in a particular turn but which was "passed over" in order to use the division option described below, may be moved during a subsequent turn when there is no piece in the appointed grid file position for that turn. If a player has no piece in the appointed grid position and no other movable pieces he must forfeit his turn or use the operation of division as described below if that option is available to him for that turn.

Figure 2:
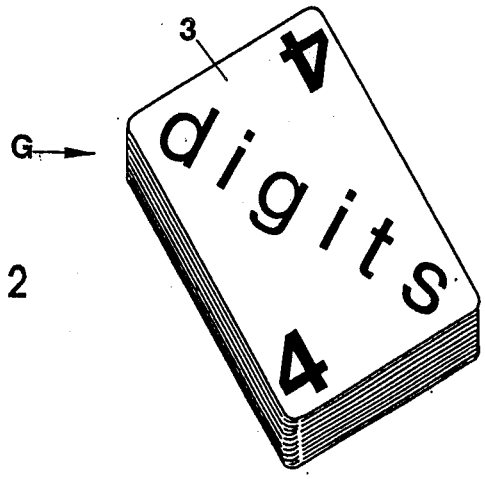
FIG. 2 shows the deck of cards used as a random number selection means with detail of the face of one card.

Movement of a piece is most often determined by performing arithmetic operations on at least two randomly determined numbers. In the preferred embodiment these random numbers are determined through the use of a card deck G as shown in FIG. 2, containing 40 cards 3. Each card 3 in the deck is printed with a number from one (1) to five (5). There are eight cards bearing each number. Random numbers are determined by drawing two cards at one time. Once drawn, cards are not put back into the deck. An arithmetic operation is then chosen by the player to be applied to numbers on the cards selected from those in the player's possession to determine the movement of an appropriate one of the player's pieces. The operation of addition, multiplication or subtraction is applied using the numbers on the cards with the resulting sum, product or difference being used to designate the number of successive grid positions or "units" which the piece will be moved. In any given turn, a player who has two cards in his possession may elect to use only one of the cards, moving in accordance with the number thereon, and keep the other in his possession until his succeeding turn. At that time it may be used with the two new cards drawn for a move based upon all three cards by applying a combination of addition and subtraction operations in any order using the numbers on all three cards in the player's possession. The player may also select two of the three cards and use the ordinary methods of play on those two cards. A player may never have more than three cards in his possession at any one time.

The quantity of movement and the path of movement of a piece can vary from one turn to another and in any given turn are dependent on and determined from the numbers taken from the selected cards in a player's possession for that turn and from the player's choice of a mathematical operation to be applied to the selected numbers. If addition or subtraction is the chosen option, the piece is moved in the direction within the same file except as described below where direction is changed at right angles to the original movement upon contact of another piece or an edge of the board. Subject to the noted exception which allows sideways movement, the movement of piece is always forward if the sum or difference is positive, or backward if the difference is negative.

If multiplication is the chosen option, the piece is moved in a direction diagonally forward, such as along a path shown by dotted line 4 in FIGS. 1 and 3 which represents a diagonal movement of six units. A "forward" movement for a player is that movement in which the player's piece advances toward the opponent's side of the board either straight ahead within the same file or diagonally such as shown by 4, where the piece moves sideways one unit into an adjacent file for each unit of direct forward movement.

If, during the course of a move, a piece must move through a grid position occupied by any other piece, the moving piece is said to have "contacted" the other piece. The contacted piece must be removed from the board regardless of which player's piece it may be. If the contacted piece is that of an opponent, it is considered to be "captured," for scoring purposes, when it is removed from the board. Once a player completes a move with his piece in his opponent's first rank (his own tenth rank), the piece is said to be "secure". A secure piece may not be captured and no move may be made in which another piece will "contact" a "secure" piece. Once "secure," a piece may only be moved if a player has no other movable pieces.

If, during a move, a piece contacts any other piece or a grid position located on an edge of the board, the moving piece must change its direction of travel by 90° at each such contact and continue its movement to complete its designated move. The exception to this defined movement occurs upon a diagonal move into a corner of the board. In such case the direction of travel is changed 180° and the move is continued to completion. As used herein the term "side" or "edge," as applied to the playing board, is used to describe any grid position which is located on either of the two outermost files or two outermost ranks.

The arithmetic operation of division is incorporated into the game by allowing a player to "divide" using the randomly chosen numbers in his possession for a given turn. Division is an option used to modify a player's score and is done in lieu of moving a piece during the turn in which it is chosen by a player. A player may "divide" only once in the game. To divide, the player totals the number of his pieces captured by his opponent and allows ten points or some other multiple, fixed prior to play, for each piece. He then divides, using the number of points for captured pieces as a dividend, and a divisor equal to any combination of arithmetic functions applied to the numbers in his possession. For example, a player possessing three cards comprising a "1", a "2", and a "3" could combine them to choose any value from 0 through 9 to determine a divisor in the following ways, $(3-2)-1=0$, $(3-2)\times 1=1$, $(3\times 1)-2=2$, $(2-1)\times 3=3$, $(3-1)\times 2=4$, $(3+2)\times 1=5$, $3\times 2\times 1=6$, $(3\times 2)+1=7$, $(3+1)\times 2=8$, $(1+2)\times 3=9$. He would then divide the chosen divisor into the number of points determined for captured pieces to give the greatest quotient, which would be added to his total score at the end of the game. The resulting quotient may be used to augment a remainder.

Although during some turns of play only one card is used to determine how a piece is moved, or no piece is moved as under "division," during at least most of the turns of play the movement of a piece is dependent on and selected after applying a mathematical or arithmetic operation using at least two numbers in possession of the player whose turn it is to play. These two or more numbers to which the operation is applied are made available to the player in a random manner but in different ways depending on the different methods of play described herein.

The game continues until each player has played ten turns. The winner is the player with the highest score. A player's score is the total of points accumulated during the game. The score for each of a player's pieces remaining on the board is based upon the final position of the piece. In the preferred method of play, referred to as "SINGLE DIGITS," a player's score includes the total of the scores for each of his pieces remaining at the end of play. The cumulative score for each piece is designated as being a number of points equal to a fixed multiple of its final rank.

In an alternative known as "DOUBLE DIGITS," the score for a piece is determined by multiplying the rank of the piece by its file, with an operation of a fixed multiple being applied to the result, such as by the operation of multiplication. In each of the described scoring methods, a player receives an assigned score, such as ten (10) points, for each opponent's piece captured. In any scoring method as described, the use of the term "fixed multiple" is not intended to limit the operation which may be used to that of the arithmetic operation of multiplication. Such "fixed multiple" can be any value which is determined prior to play or which can be determined by any defined formula or method. The value could be, for example, the number marked on a piece, and could be operated on by any predetermined mathematical function or operation.

Alternative methods of play may allow, for instance, only "addition" moves or only "multiplication" moves. These variations are referred to as "ADD-OUT DIGITS" and "TIMES-OUT DIGITS" respectively.

Many playing and scoring variations are possible by taking into account varied markings of the pieces. In one variation in which numbered markings are considered, the winner of the game may be determined as being that player who, at the end of play has positioned the greatest number of pieces into the opponent's first rank in a manner such that the number of a piece corresponds to the opponent's file number printed on the board for that position where the piece is located. In the event that both players have the same number of "matches" as described, any of the other methods of scoring may be used to break the tie and determine the winner. This scoring variation is referred to as "CROSS-DIGITS".

Where the game is played taking into account letter markings, the winner may be determined as being that player who, at the end of play has captured the greatest number of pieces containing the letters included in a predefined word or pattern, but using only such captured letters as can be arranged in consecutive order beginning with the first letter of the word or pattern to form a proportionate part of the word or pattern. As shown and described herein such a predefined word or pattern would be "DIGIT" or "DIGITDIGIT."

In another variation of play, movement of the pieces and scoring take place according to any of the previously described variations. However, prior to play the deck of numbered cards is randomly dealt out, with each player receiving an equal number of cards. Each player arranges his or her cards in any desired order. The cards will then come into a player's possession for play according to that ordering of the cards, just as if the cards were randomly drawn as previously described, and must be played in that order. Each player then makes a "bid" to predict his or her final score according to the chosen method of scoring. A player's bid may be taken into account for scoring purposes in several ways. At the end of a game each player receives a "raw" score. This raw score is that score which is determined by one of the scoring methods as described herein, without taking into account the bid made prior to play.

In a first method of scoring by taking a player's bid into account, each player makes a bid in secrecy and the player's bids are then revealed and compared. The game is played so that the player with the highest bid attempts to achieve a raw score equal to or surpassing his bid while his opponent attempts to minimize the high bidder's raw score. If the high bidder achieves a score equal to or surpassing his bid, he is the winner of the game. Otherwise, his opponent is the winner.

In another variation, a player whose raw score equals or surpasses his bid has his bid added to his raw score to give a final score.

In a third variation a player's raw score is decreased by the difference between his raw score and his bid to give a final score.

Another variation of bidding rewards the high bidder if he is successful in his bid by augmenting his score with a number of points equal to the difference between the bids of the players.

Where bidding is used, the winner is preferably the player who accumulates the greatest score over a series of individual games. When several games are played, the loser of any game makes the opening move in the subsequent game.

Several types of alternative apparatus and rules of play would be within the spirit of the present invention. The board may comprise any grid-like pattern such as a pegboard with holes to define each grid position. The means of selecting random numbers may include ordinary dice or any other device or devices, such as a device used to choose numbers arranged around a wheel by spinning a pointer located at the center thereof which would randomly point to a particular number upon coming to rest.

Other variations within the scope of this invention will be apparent from the described embodiment and it is intended that the present descriptions be illustrative of the inventive features encompassed by the appended claims.

What is claimed is:

1. A method of play of a game of chance and strategy played by at least two players, wherein said method comprises:

providing a playing board comprising a plurality of distinct positions in a pattern of rows crossed in at least two different directions, each distinct position being defined by the intersection of at least two rows oriented in different directions;

providing a plurality of playing pieces for each player to be moved from one position to another on said board, providing for the possession of a player for each turn of play at least one number, the movement of a respective piece during at least most of the turns of play being possible over different paths and being dependent on and selected after applying a mathematical operation using at least two numbers in the possession of the player.

2. A method of play of a game according to claim 1 wherein the means for providing numbers comprises a deck of individually numbered cards, said numbers being those found on individual cards in said deck.

3. A method of play of a game according to claim 1 wherein the mathematical operation is one of several operations including addition, subtraction and multiplication.

4. A method of play of a game according to claim 1 wherein the number of pieces for each player is equal to the number of playing positions along the player's side of the board; and play is begun with each of a player's pieces occupying a distinct position along said side.

5. A method of play of a game according to claim 1 including means for scoring wherein each rank and each file of the playing board is assigned a numerical value, each grid position on the playing board has an assigned numerical value, said last numerical value being the result of a mathematical operation applied to the numerical value of the rank, or to the numerical value of the file, or to the numerical values of both the rank and file, of the said grid position, and the numerical value of the grid position is attributed to a playing piece located at that position, and a player's score is determined at least in part by the values assigned to individual pieces on the board.

6. A method of play of a game according to claim 1 including means for scoring wherein each playing piece is marked with a numeric value which may be hidden or visible during play and a player's score is determined at least in part by the values assigned to respective pieces.

7. A method of play of a game according to claim 1 including means for scoring wherein upon the contact of any opponent's piece during movement of a player's piece, the opponent's piece is "captured" and removed from the board and a player's score is at least partially determined by the number of opponent's pieces captured.

8. A method of play of a game according to claim 1, including scoring means for establishing a raw score resulting from play of the game, wherein prior to the beginning of play each player makes a bid to predict his raw score, the bids being used with the respective raw scores to determine the winner in accordance with rules agreed upon prior to the beginning of play of the game.

9. A method of play of a game of chance and strategy played by at least two players, wherein said method comprises:

providing a playing board comprising a grid pattern of ranks and files to denote distinct positions on said board, providing a plurality of playing pieces, each said piece being movable in variable paths on said board, the initial and final position of each piece being moved each corresponding in size to a respective grid position on said board, providing random numbers for each player to have available for use during play;

wherein the path and extent of movement of a piece during each player's play during at least most of his turn's of play is determined by applying an arithmetic operation using two or more of said available numbers, said arithmetic operation being chosen by the player.

10. A method of play of a game according to claim 9 wherein the means for selecting random numbers comprises a deck of individually numbered cards, said random numbers being those found on individual cards in said deck.

11. A method of play of a game according to claim 10 wherein the movement of a piece over a number of grid positions is controlled by a result equal to the additive sum of said two or more available numbers, the subtractive difference of those numbers or the multiplicative product of those numbers, the movement being at least initiated parallel to a file for additive or subtractive results and diagonally forward for a multiplicative result.

12. A method of play of a game according to claim 9 wherein the arithmetic operation is chosen from at least addition, subtraction and multiplication.

13. A method of play of a game according to claim 9 wherein the direction of the path of further movement of a piece is changed from a proceeding direction of movement to complete the move if the player's piece should contact either an edge of the board or any other piece.

14. A method of play of a game according to claim 9 wherein said number of pieces is equal to the number of files on said board; and play is begun with each of a player's pieces occupying a distinct grid position within the player's first rank.

15. A method of play of a game according to claim 9 including means for scoring, wherein each rank and each file of the playing board is assigned a numerical value, each grid position on the playing board has an assigned numerical value, said last numerical value being the result of a mathematical operation applied to the numerical value of the rank, or to the numerical value of the file, or to the numerical values of both the rank and file, of the said grid position, a player's score being at least partially determined from the value of the grid position of each of the player's pieces at the end of play.

16. A method of play of a game according to claim 15 wherein the score for each of a player's pieces is at least partially determined by applying an arithmetic function to the value of the rank of the grid position of each said piece at the end of play.

17. A method of play of a game according to claim 15 wherein a player's score is at least partially determined by the sum of the scores for each of a player's pieces, the score for each piece being determined by applying arithmetic operations to the numbers corresponding to the rank and file positions of a player's pieces at the end of play.

18. A method of play of a game according to claim 15 wherein a player's score is the total of scores for each of the player's pieces remaining on the board at the end of play, the score for each piece being a multiple of the multiplicative product of the rank and file of that piece at the end of play.

19. A method of play of a game according to claim 15 wherein each of a player's pieces has first and second faces, each said first face being marked with a number, said second face being marked with a letter, in such a manner that the numbers on the first faces of all such pieces of a player are consecutive and distinct and the letters on the second said faces of pieces of a player form a defined pattern or word.

20. A method of play of a game according to claim 15 wherein each of said pieces is marked with a number, and said score for each said piece at the end of play is at least partially determined by using the number marked thereon.

21. A method of play of a game according to claim 9 wherein upon the contact of any opponent's piece during movement of a player's piece, the opponent's piece is "captured" and removed from the board.

22. A method of play of a game according to claim 21, including scoring means, wherein a player's score is at least partially determined by the number of opponent's pieces captured.

23. A method of play of a game according to claim 21, including scoring means, wherein a player's score is at least partially determined from the rank and file position of the captured piece at the time of capture.

24. A method of play of a game according to claim 21, including scoring means, wherein a player's score is at least partially determined by an election available during play to "divide" a divisor equal to any combination of arithmetic functions applied to the numbers in his possession into a dividend equal to a fixed multiple of the number of pieces captured by an opponent, the resulting quotient being added to the player's score.

25. A method of play of a game according to claim 21 wherein each of said pieces is marked with a letter, each said letter for each player being one of the included letters in a predefined word or pattern, the winner of the game being determined using the combination of said letters on captured pieces of an opponent, wherein the winner is the player who is able to achieve the greatest proportion in consecutive order of said predefined word or pattern formed by said combination of letters.

26. A method of play of a game according to claim 9, including scoring means for establishing a raw score resulting from play of the game, wherein prior to the beginning of play each player makes a bid to predict his raw score, the bids being used with the respective raw scores to determine the winner in accordance with rules agreed upon prior to the beginning of play of the game.

27. A game of chance and strategy played by opposing players, using apparatus comprising:

a playing board comprising a plurality of distinct positions in a pattern of mutually perpendicular ranks and files crossed in two different directions, each distinct position being usable by pieces of both players during play of the game and defined by the intersection of one rank and one file oriented in different directions, said board having indicia thereon indicating for each player a numeric value of the file and of the rank for each position on the board, said board having opposite first player and second player sides along which the first rank for each respective player extends, the numeric values for the ranks for each player increasing in the direction from each respective player's side toward the opposing player's side of the board, said board having third and fourth sides parallel to said files, the numeric values of said files for one player increasing in the direction from said third side toward said fourth side and the numeric values of said files for the other player increasing in the direction from said fourth side toward said third side, the combination of numeric values of both rank and file being distinct for at least most of the positions on the board;

a plurality of playing pieces for each player to be moved from one position to another on said board; means for providing for the possession of a player for each turn of play at least one number, and prescribed rules for the movement of respective playing pieces during at least most of the turns of play, such movement being possible over different paths and being dependent on and selected after applying a mathematical operation using at least two numbers in the possession of the player.

* * * * *